US011008862B2

(12) United States Patent
Breuer et al.

(10) Patent No.: US 11,008,862 B2
(45) Date of Patent: May 18, 2021

(54) HYDROSTATIC PISTON ENGINE

(71) Applicant: Robert Bosch GmbH, Stuttgart (DE)

(72) Inventors: David Breuer, Tuebingen (DE); Timo Nafz, Horb (DE); Stefan Merz, Hechingen (DE)

(73) Assignee: Robert Bosch GmbH, Stuttgart (DE)

( * ) Notice: Subject to any disclaimer, the term of this patent is extended or adjusted under 35 U.S.C. 154(b) by 238 days.

(21) Appl. No.: 16/210,777

(22) Filed: Dec. 5, 2018

(65) Prior Publication Data

US 2019/0178226 A1 Jun. 13, 2019

(30) Foreign Application Priority Data

Dec. 11, 2017 (DE) ..... 10 2017 222 354.5

(51) Int. Cl.

| | |
|---|---|
| ***F01B 3/00*** | (2006.01) |
| ***F04B 1/2021*** | (2020.01) |
| ***F03C 1/06*** | (2006.01) |
| ***F03C 1/34*** | (2006.01) |
| ***F04B 1/2042*** | (2020.01) |

(52) U.S. Cl.

CPC ..... *F01B 3/0047* (2013.01); *F01B 3/0055* (2013.01); *F03C 1/0647* (2013.01); *F03C 1/0655* (2013.01); *F04B 1/2021* (2013.01); *F04B 1/2042* (2013.01)

(58) Field of Classification Search

CPC .... F03C 1/0647; F03C 1/0655; F04B 1/2021; F04B 1/2042; F01B 3/0055; F01B 3/0047; F01B 3/0058; F01C 1/0657

See application file for complete search history.

(56) References Cited

U.S. PATENT DOCUMENTS 3,457,873 A 7/1969 Fischer et al.
3,699,845 A * 10/1972 Ifield ..... F04B 1/2042 91/6.5

(Continued)

FOREIGN PATENT DOCUMENTS

CN 103939330 A 7/2014
DE 20 38 086 2/1972

(Continued)

OTHER PUBLICATIONS

German Patent Office Search Report dated Jul. 6, 2018 (German language, 9 pages).

*Primary Examiner* — Bryan M Lettman
(74) *Attorney, Agent, or Firm* — Maginot, Moore & Beck LLP

(57) ABSTRACT

A hydrostatic piston engine comprises a housing with a cylinder drum with cylinder bores mounted rotatably therein. Each of the cylinder bores receives a working piston in a longitudinally displaceable manner, via which a hydrostatic working chamber is delimited by the cylinder bore. The hydrostatic working chamber has an opening on an outer surface of the cylinder drum by which, when the cylinder drum rotates, outlets of a high-pressure chamber and of a low-pressure chamber of the piston engine and a reversing surface arranged between the two outlets in the rotational direction can be passed over in alternating fashion. At least one pressurizing medium channel is provided which, on one hand, opens out in the reversing surface and, on the other, into a pressurizing medium trough of the piston engine.

16 Claims, 4 Drawing Sheets

(56) References Cited

U.S. PATENT DOCUMENTS

| | | | | |
|---|---|---|---|---|
| 4,489,642 | A | 12/1984 | Westveer | |
| 6,186,748 | B1 * | 2/2001 | Umeda | F04B 1/2042 417/269 |
| 2014/0109761 | A1 | 4/2014 | Johnson et al. | |

FOREIGN PATENT DOCUMENTS

| | | | |
|---|---|---|---|
| DE | 26 13 478 | | 10/1977 |
| DE | 699 34 173 | T2 | 10/2007 |
| DE | 10 2010 055 398 | A1 | 6/2012 |
| JP | 8-210242 | A | 8/1996 |
| JP | 2006-207501 | A | 8/2006 |

* cited by examiner

HYDROSTATIC PISTON ENGINE

This application claims priority under 35 U.S.C. § 119 to patent application number DE 10 2017 222 354.5, filed on Dec. 11, 2017 in Germany, the disclosure of which is incorporated herein by reference in its entirety.

BACKGROUND

The disclosure relates to a hydrostatic piston engine according to the following description.

A generic hydrostatic piston engine has a cylinder drum with cylinder bores and working pistons guided therein in a longitudinally displaceable manner. Said pistons are, on the one hand, supported in a sliding manner on a lifting surface running at a variable distance from the cylinder drum and, on the other hand, they delimit hydrostatic working chambers in the cylinder drum which they enter and leave alternately when the cylinder drum rotates on account of their support on the lifting surface. The hydrostatic working chambers each have an outlet to the cylinder drum which, when the cylinder drum rotates, is brought into alternating pressurizing medium connection with a high-pressure chamber and a low-pressure chamber. A reversing surface passed over by the outlet of the working chamber is arranged between the outlets of the low-pressure chamber and of the high-pressure chamber, via which reversing surface the outlet of the working chamber is separated in a fluid-tight manner from both the low-pressure chamber and also the high-pressure chamber during the passing over. In this way, a pressure change can take place in the working chamber without a hydraulic bypass between the high-pressure and low-pressure chambers. In pump mode, the cylinder drum is driven and a hydrostatic working chamber passing over the low-pressure chamber with its outlet is extended on account of the extending working piston. In this way, low-pressure pressurizing medium flows from the low-pressure chamber into the hydrostatic working chamber. Shortly before the working piston has reached its maximum stroke or dead point, the pressurizing medium connection of the hydrostatic working chamber to the low-pressure chamber is separated when passing over the reversing surface. Due to the lifting surface, the introduction of the working piston into the cylinder bore, and therefore the pressure increase in the hydrostatic working chamber, begins at the dead point. As the rotation continues, the outlet thereof then comes into pressurizing medium connection with the high-pressure chamber of the piston engine in which, for example, the load pressure of a load to be moved is applied. The introduction of the working piston causes the pressurizing medium to be ejected under load pressure into the high-pressure chamber and, for example, to a high-pressure connection of the piston engine and further to the consumer. Just before the next dead point is reached, at which the working piston is introduced to its maximum, the pressurizing medium connection of the hydrostatic working chamber to the high-pressure chamber is disconnected when the other reversing surface is passed over. Since the working piston is introduced a little further, there is usually a further pressure increase in the hydrostatic working chamber up to the dead point. If the cylinder drum is rotated further, then the hydrostatic working chamber comes into pressurizing medium connection with the low-pressure chamber via its outlet.

Since high pressure is still present at this point in the hydrostatic working chamber, the pressurizing medium decreases in pressure, insofar as no further precautions have been taken, into the low-pressure chamber. Large flow speeds which result in turbulence in the low-pressure chamber can occur during this. The greater the high pressure and/or the speed of the cylinder drum in this case, the more turbulent the effects in the low-pressure chamber. This can lead to vapor formation or cavitation in the low-pressure chamber which can have two effects. On the one hand, cavitation erosion can occur in this region; on the other hand, this means that the vapor formation reduces the incompressibility of the pressurizing medium, leading to a poorer filling of the aspirating hydrostatic chamber. The consequences may be: damage to engine components, poorer engine efficiency and uncoupling of the pressurizing medium volume flow from the speed.

In order to reduce these effects, solutions which propose reversing notches with a flow cross section that widens in the rotational direction are widespread in the prior art. These reversing notches originate with a cross section of zero in the reversing surface and extend with a substantially V-shaped or U-shaped cross section in the rotational direction up to the outlet of the low-pressure chamber into which they open.

Although an improvement is achieved by means of these reversing notches, the aforementioned problems can still occur as the high pressure is directly decreased in the low-pressure chamber and, depending on the speed and the high pressure, can guarantee the aforementioned turbulence there.

Other solutions show the connection of the high pressure-guiding hydrostatic working chamber in the region of the reversing surface to the inner chamber of the hydrostatic engine. This preliminary pressure drop or down-regulation of the working chamber means that during the subsequent connection to the working chamber, the pressurizing medium connection no longer swirls in such a manner, so that the negative effects described are reduced. Hence, for example, publication U.S. Pat. No. 3,457,873 discloses a connection of the hydrostatic working chamber via the reversing surface to the housing interior. This takes place via a pressurizing medium channel which extends from its outlet in the reversing surface through a connection plate which has outlets both of the high-pressure chamber and also of the low-pressure chamber into the housing interior.

The disadvantage of this solution is that when the rotational direction is reversed an air/oil mixture can be drawn in via the pressurizing medium channel, which in turn leads to the aforementioned problems.

In order to solve this problem, publication DE 10 2010 055 398 A1 proposes that a non-return valve opening towards the housing interior should be inserted in the aforementioned pressurizing medium channel. In this way, only the originally intended reset takes place via the pressurizing medium channel without any further aspiration.

A further disadvantage of both solutions, however, is that the aforementioned pressurizing medium channels have a further tendency towards cavitation at sufficiently high pressures or speeds.

SUMMARY

In view of this, the problem addressed by the disclosure is that of creating a hydrostatic piston engine with a reset which, with otherwise identical operating state variables such as speed and working pressure, has a lesser tendency towards cavitation of the reset.

This problem is solved by a hydrostatic piston engine having the features of the following description.

Advantageous developments of the hydrostatic piston engine are described below.

A hydrostatic piston engine has a housing with a cylinder drum with cylinder bores mounted rotatably therein, each of which cylinder bores receives a working piston in a longitudinally displaceable manner. The piston engine may, for example, be a radial piston engine or a hydrostatic axial piston engine with a swash plate design. It may take the form of a hydraulic motor and/or a hydraulic pump. In the case of the radial piston engine, the working pistons extend in relation to a rotational axis of the cylinder drum radially therefrom; in the second case, they emerge at the face side of the cylinder drum substantially parallel or parallel to the rotational axis. Each cylinder bore delimits a hydrostatic working chamber of variable volume with its working piston guided therein, said working chamber having an opening on an outer surface of the cylinder drum—in the case of the radial piston engine on a radial curved surface and in the case of the axial piston engine on a curved surface on the face side. During a rotation of the cylinder drum, outlets in a high-pressure chamber and a low-pressure chamber of the piston engine and a reversing surface arranged in the rotational direction between the two outlets are capable of being passed over, in particular are passed over, alternately by the openings in the working chambers. In this case, at least one pressurizing medium channel is provided, in particular to reset the high pressure of the working chambers in a pressurizing medium trough separate from the low-pressure chamber, which pressurizing medium channel opens out, on the one hand, in the reversing surface and, on the other hand, in the pressurizing medium trough, in particular in a housing interior of the piston engine. According to the disclosure, this pressurizing medium channel has a first portion along which a flow cross section increases towards the pressurizing medium trough.

Due to the increasing flow cross section, the flow speed in the pressurizing medium channel can drop along the first portion, something that is associated with a pressure rise along the first portion. In this way, vapor formation or cavitation is more effectively prevented. Consequently, the piston engine is better protected from cavitation-related wear in this region. Since the low-pressure chamber is no longer as highly swirled following the reset, the efficiency and aspiration are improved.

In a development, the pressurizing medium channel has a second portion in the direction of the pressurizing medium trough arranged downstream of the first portion. The flow cross section along this is constant up to the pressurizing medium trough, or it diminishes. In other words, the pressurizing medium channel narrows once again. Alternatively or in addition, the second portion in the flow direction has a curvature via which the pressurizing medium volume flow is deflected in the pressurizing medium channel in the direction of the pressurizing medium trough. Tests show that through the further narrowing of the pressurizing medium channel and/or the curvature, even better protection against cavitation can be achieved.

In one development the pressurizing medium channel opens with its first portion into the pressurizing medium trough or, if there is a second portion, it opens with its second portion into the pressurizing medium trough.

Particularly good protection from cavitation is exhibited by the pressurizing medium channel in a development in which the flow cross section of at least the first portion increases in a continuous or stepless manner. In this way, separations of the flow from an inner curved surface of the pressurizing medium channel that promote cavitation are prevented.

A development in which an inner curved surface of the pressurizing medium channel or at least of the first portion has a smooth and/or stepless design, at least sectionally, has proved advantageous in principle.

A smooth or stepless inner curved surface is produced, for example, when it has a tangentially constant design. In other words, there are no edges on the inner curved surface. The inner curved surface exhibits an even greater surface quality if it is configured with a constant curvature, for example. In other words, the change in tangent on the inner curved surface is also continuous.

In a further development, the pressurizing medium channel extends up to the pressurizing medium trough at least sectionally with the rotational direction.

Alternatively or in addition, the pressurizing medium channel may extend up to the pressurizing medium trough at least sectionally against the rotational direction.

In one development the pressurizing medium channel extends up to the pressurizing medium trough radially outwards at least sectionally, in particular in and/or against the rotational direction. A spiral arm-shaped embodiment of the pressurizing medium channel relative to a rotational plane of the cylinder drum results, for example, from a radially outward extension in the rotational direction.

In a preferred development, a control plate that is detachable from the housing portion is arranged between the cylinder drum and a housing portion which supports a low-pressure connection and a high-pressure connection connected to the low-pressure chamber and the high-pressure chamber, respectively. The outer surface of the cylinder drum is in abutment with the control plate. In this design, the reversing surface or reversing surfaces, the outlets of the at least one pressurizing medium channel and of the high-pressure and low-pressure chamber are configured on the control plate.

With this design, the low-pressure chamber and the high-pressure chamber each have a main portion in the housing portion and one or more end portions in the control plate. The end portions in this case are, in particular, in the shape of one or more through-bores or control kidneys.

In the case of the design with the housing portion and detachable control plate, a development in which the pressurizing medium channel is configured at least sectionally by a groove formed on the housing portion and the control plate covering this groove sectionally proves easy to produce. The groove-like embodiment in this case allows simple production by milling, for example. Unlike in the case of solutions of the prior art, as discussed, the pressurizing medium channels are not therefore inserted through bores into the housing portion. By milling, a substantially more versatile and variable cross-sectional profile can be produced at very little expense. The covering control plate then completes the inner curved surface of the pressurizing medium channel.

In one development the groove in the flow direction has a trough-shaped base. This is the case, for example, if a base of the groove drops off along the first portion and rises again along the second portion relative to a bearing surface of the housing portion on which the control plate rests. Tests have shown that the rising portion reduces the cavitation tendency in the pressurizing medium channel due to its decreasing flow cross section and/or due to its curvature formed in the flow direction.

In one development the second portion is not covered by the control plate. In other words, the second portion is only delimited or created by the groove and not by the control plate. This is the case, for example, if the pressurizing medium channel, in particular the groove, extends beyond an outer circumference of the control plate.

The pressurizing medium channel is comparatively easy to produce when the first portion extends starting from the bearing surface of the housing portion on which the control plate rests. In other words, the first portion with the widening flow cross section does not begin right at the reversing surface of the control plate, but only at the housing portion. A portion of the pressurizing medium channel can then be configured as a simple through-bore hole from the outlet thereof in the reversing surface up to the bearing surface.

Alternatively, the first portion may extend at a distance from the bearing surface of the housing portion. For example, starting from the bearing surface a bore can initially be placed in the housing portion, from which the first portion with the widening flow cross section then extends.

As an alternative to the aforementioned solutions, the first portion may also extend, however, starting from the reversing surface of the control plate.

Tests have shown that the reset is less threatened by cavitation if more than one pressurizing medium channel of this kind is provided per reversing surface. There may be two or three pressurizing medium channels or more, for example. These may extend, for example, in or against the rotational direction or individually, one in and one against the rotational direction. A combination of a pressurizing medium channel that extends in the rotational direction and another pressurizing medium channel that extends against the rotational direction has proved advantageous.

Outlets in both or multiple pressurizing medium channels are arranged in the reversing surface that can be passed over. A substantially synchronous pressurizing medium connection between the opening in the working chamber that is passing over and the pressurizing medium channels takes place when these have outlets offset radially to one another relative to the rotational axis of the cylinder drum, for example. This is a preferred solution in axial piston engines. Alternatively or in addition, an offset of the outlets of the pressurizing medium channels in the reversing surface can of course also be provided in the rotational direction.

In one development the piston engine is configured for a rotational direction and/or torque reversal. In this case, a development in which one or more pressurizing medium channels open out, as described, in another reversing surface arranged diametrically to the aforementioned reversing surface, has proved advantageous. In this way, the aforementioned reset is possible for each rotational direction.

In order to avoid the aspiration of an air/oil mixture via the pressurizing medium channel when the rotational direction is reversed, the pressurizing medium channels preferably each have a non-return valve opening towards the pressurizing medium trough.

As an alternative to the design with the aforementioned control plate, the outside surface of the cylinder drum may be directly in abutment with the housing portion. The outlets of the high-pressure and low-pressure chamber and the reversing surface or reversing surfaces are then formed on the housing portion, in particular on the connection plate or the housing cover. Although this design comprises one fewer component—the control plate is missing—an ever-present possibility of wear on the face side of the housing portion which exhibits the aforementioned outlets of the high-pressure and low-pressure chamber compared with the design with the control plate leads to a high repair cost, since the housing portion which is expensive to produce has to be reworked or replaced instead of the simple control plate.

An exemplary embodiment of a hydrostatic piston engine according to the disclosure is depicted in the drawings. The disclosure is explained in greater detail below with the help of the figures in these drawings.

DETAILED DESCRIPTION

Figure 1:
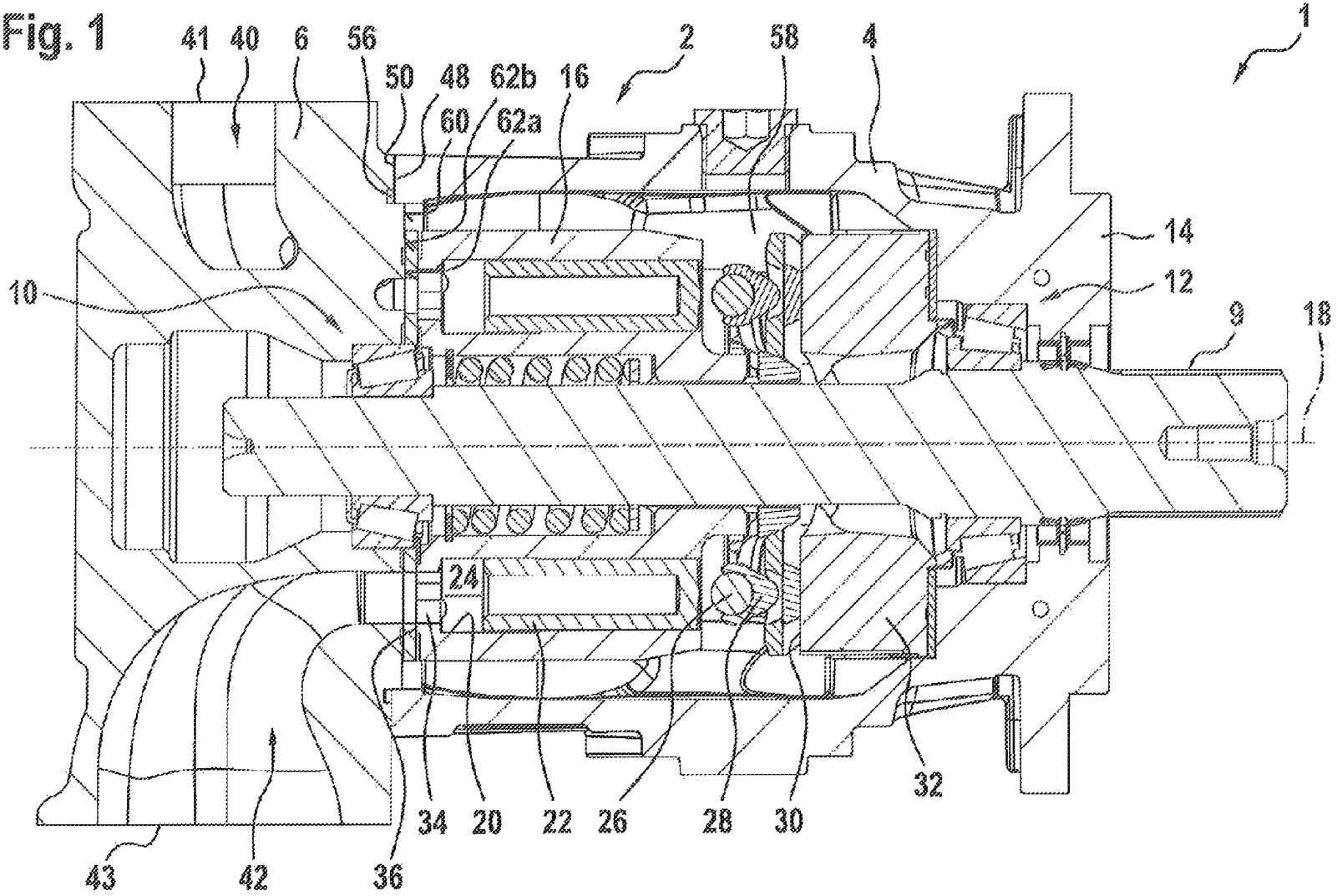
FIG. 1 shows a longitudinal section of a hydrostatic axial piston engine according to an exemplary embodiment.

According to FIG. 1, an axial piston engine 1 which is configured in a swash plate design has a housing 2 with a substantially cup-shaped housing part 4 which is closed on the face side by a connecting cover or a connection plate 6. A drive shaft 8 is rotatably mounted in the housing 2 via rolling bearings 10, 12. In this case, the rolling bearing 10 is arranged on the connection plate 6 and the rolling bearing 12 on a base 14 of the housing part 4. A base 14 of the housing part 4 has the drive shaft 8 passing through it, so that a drive shaft stub 9 projects outwardly to transmit a torque. A cylinder drum 16 into which a plurality of cylinder bores 20 parallel to the rotational axis 18 are introduced on a reference circle arranged concentrically to a rotational axis 18 of the drive shaft 8 is connected to the drive shaft 8 in a non-rotational manner A working piston 22 is received in a longitudinally displaceable manner in the respective cylinder bore 20, as a result of which a hydrostatic working chamber 24 is delimited by the cylinder bore 20 and the working piston 22 in each case. Due to the hollow design of the working pistons 22, the working chambers 24 extend into the working pistons 22. They each project on a face side of the cylinder drum 16 pointing to the base 14 from the cylinder bores 20 and are supported in a sliding manner by heads 26 indirectly via sliding shoes 28 on a sliding surface 30 of a pivoting cradle 32 adjustably mounted on the housing part 4. An inclined plane or swash plate with an adjustable setting angle relative to the rotational axis 18 is formed via the sliding surface 30. The section shown in FIG. 1 depicts the longitudinal section in a plane which stretches from the rotational axis 18 and a pivot axis of the pivoting cradle 32.

On the opposite face side 36 of the cylinder drum 16 the hydrostatic working chambers 24 have openings 34. The face side 36 is in abutment with a control plate 38 via which an alternating pressurizing medium connection to a high-pressure chamber 40 arranged in the connection plate 6 and a low-pressure chamber 42 arranged there is made. The high-pressure chamber 40 has a high-pressure opening 41 on the connection plate 6 and the low-pressure chamber 42 has a low-pressure outlet 43 on the connection plate 6. The outlets 41, 43 are suitable for being connected to a pressurizing medium connection. The control plate 38 has through-recesses in a known manner for the alternating pressurizing medium connection of the hydrostatic working chambers 24 to the pressure chambers 40, 42. See FIG. 2 in this respect. It can be seen there that the control plate 38 has a large, kidney-shaped through-recess 44 or low-pressure kidney 44 which in principle represents part of the low-pressure chamber 42 or the axial extension thereof in the control plate 38. The high-pressure chamber 40 is extended into the control plate 38 via five through-bores 46 arranged along the same reference circle as the low-pressure kidney 44.

Figure 2:
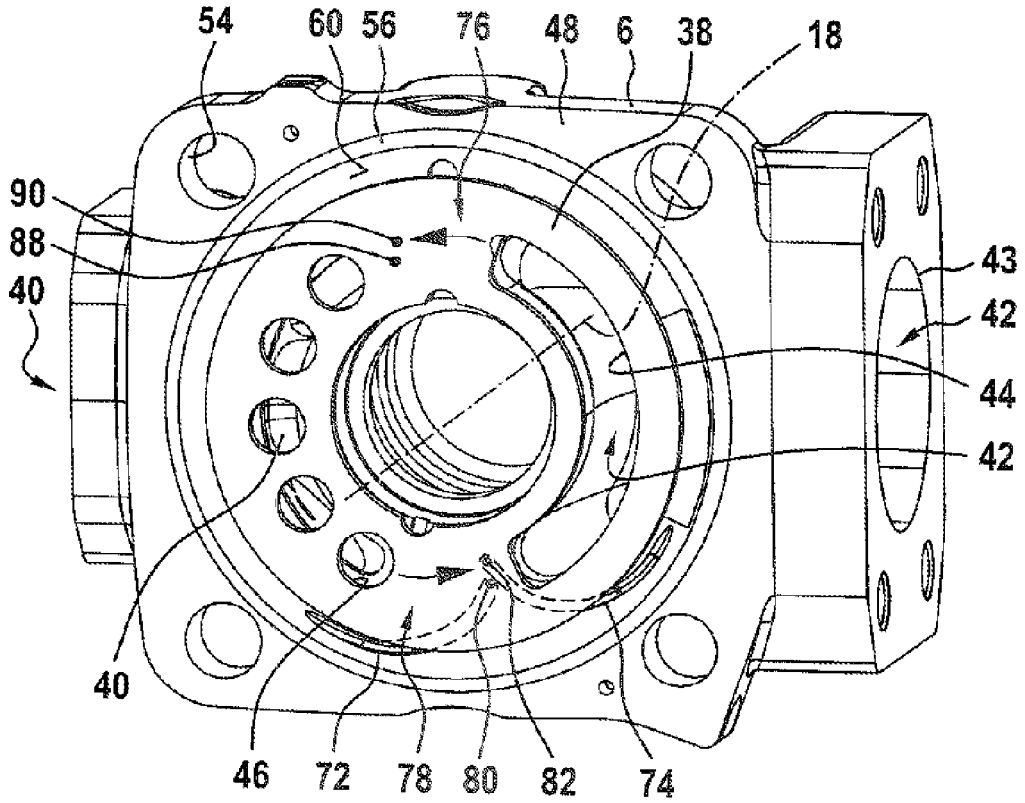
FIG. 2 shows a connection plate of the axial piston engine according to FIG. 1 with a control plate.
Figure 3:
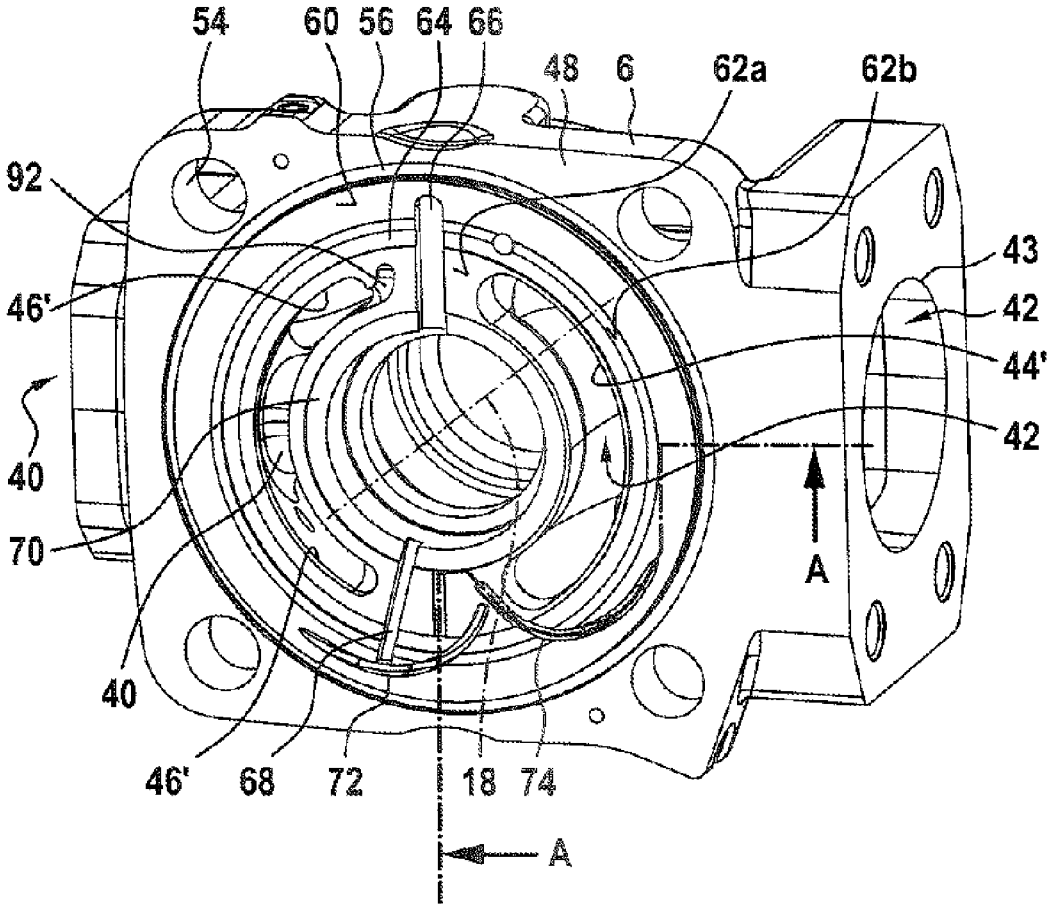
FIG. 3 shows the connection plate according to FIG. 2.

FIG. 3 shows the face side of the connection plate 6 which, in order to close the housing part 4, is placed on the face side on the opening thereof. For this purpose, the connection plate 6 has a sealing surface on the face side 48 which can be brought into abutment with a ring-shaped face side 50 of the housing part 4 according to FIG. 1. The connection plate 6 also has four through-bores 54 into which screws can be introduced to attach the connection plate 6 to the housing part 4 by flanges. A sealing groove 56 is introduced into the sealing surface 48 concentrically to the rotational axis 18. In order to seal a housing interior 58 in accordance with FIG. 1, in which the cylinder drum 16 is received, an O-ring (not shown) is introduced into it. A low-pressure area 60 that is raised in relation to the groove 56 is attached radially inwardly. According to FIG. 1, a circumferential area drops away from the low-pressure area 60 radially outwardly into the sealing groove 56, via which the connection plate 6 according to FIG. 1 is centered on an inner curved surface of the housing part 4. A bearing surface 62 divided by a groove 64 into two substantially ring-shaped partial surfaces 62*a* and 62*b* according to FIG. 3 is attached radially inwardly to the low-pressure area 60 that terminates the housing interior 58 axially according to FIG. 1. In this case, 62*a* is a radially inner bearing surface and 62*b* a radially outer bearing surface. Both bearing surfaces 62*a*, 62*b* are used according to FIGS. 1 and 2 as the single bearing means of the control plate 38 on the connection plate 6.

A low-pressure kidney 44' corresponding to the low-pressure kidney 44 and a high-pressure kidney 46' corresponding to the through-bores 46 of the control plate 38 are formed in the bearing surface 62*a*. The bearing surface 62*a* has a comparatively small extension in the radial direction, which means that in the region of the low-pressure and high-pressure kidneys 44', 46' a bearing of the control plate 38 with a comparatively high surface pressure takes place, in this way both the low-pressure kidney 44' and the high-pressure kidney 46' are already sealed comparatively well in respect of one another by the pressing force of the control plate 38 onto the bearing surface 62*a*. Consequently, a high-pressure field expands during operation, starting from the high-pressure kidney 46', between the inner bearing surface 62*a* and the supported plate 38. In order to delimit this high-pressure field, in particular to delimit the unloading force resulting from the high-pressure field and acting in a lifting manner on the control plate 38, two grooves 66 and 68 running in a radial direction are provided in the connection plate 6. Radially inwards of the inner bearing surface 62*a* is attached a ring-shaped low-pressure area 70 lowered axially in respect of the aforementioned bearing surface. Via the surface and groove system made up of the ring surface 70, radial grooves 68, 66 and the ring groove 64, there results on the face side of the connection plate 6 shown according to FIGS. 2, 3, 4 and 5 a low-pressure field which is in pressurizing medium connection with the housing interior 58 according to FIG. 1. The high-pressure field is delimited by this low-pressure field.

On observing FIGS. 2 to 5 two further grooves 72 and 74 are evident which extend starting from the inner bearing surface 62*a*, crossing the ring groove 64 and the outer bearing surface 62*b*, up to the low-pressure area 60, from radially inwardly to radially outwardly, in a similar manner to a spiral arm. The two grooves 72, 74 are part of the pressurizing medium channels according to the disclosure, via which a reset of the pressurizing medium connection of the hydrostatic working chambers 24 during the changing thereof from high pressure to low pressure takes place.

On observing FIG. 2 it becomes evident that two reversing surfaces 76 and 78 are arranged on the control plate 38 between the low-pressure kidney 44 and the group of through-bores 46 on the high-pressure side. During operation of the axial piston engine 1—this being assumed to be in pump mode—the rotational direction of the cylinder drum 16, as shown in FIG. 2, is symbolized by the two arrows shown, so in an anti-clockwise direction according to FIG. 2. In relation to FIG. 1, during this rotation of the cylinder drum 16 the working chamber 24 depicted below moves into the observation plane and the upper working chamber towards the observer.

If the openings 34 pass over the low-pressure kidney 44 according to the aforementioned rotational direction, the working pistons 22 according to FIG. 1 extend from the cylinder bore 22 in the direction of the swash plate 30. In this way, pressurizing medium is drawn from the low-pressure chamber 42 into the hydrostatic working chamber 24, so the hydrostatic working chambers 24 are filled via their openings 34 with pressurizing medium at low pressure. Close to a maximum extension stroke or dead point of the working piston 22, the openings 34 pass over the reversing surface 76, so that the hydrostatic working chambers 24 are separated from the low-pressure chamber 24 by the reversing surface 76. There is still a slight additional enlargement of the hydrostatic working chamber 24 up to the dead point which coincides with the position of the radial groove 66 according to FIG. 4. The introduction of the working piston 22 into the cylinder bore 20 takes place on the other side thereof. Meanwhile, in the high-pressure chamber 40 the load pressure of the consumer prevails, to which the axial piston engine 1 which is working in pump mode conveys. With a further rotation in an anti-clockwise direction according to FIG. 2, the hydrostatic working chambers 24 come into pressurizing medium connection with the high-pressure chamber 40. Due to the inclined plane of the swash plate 30 and the resulting insertion stroke of the working pistons 22, said pistons eject the pressurizing medium present in the hydrostatic working chambers 24 into the high-pressure chamber 40 (up to the consumer). This takes place via the through-recesses 46 of the control plate 38. The total of the through-recesses 46 could be configured as a closed kidney, in a similar manner to the low-pressure kidney 44. However, since strong radial forces act on the control plate 38 in the region of the high pressure, the embodiment shown with a plurality of bores with webs between the bores has proved more stable.

After the last through-recess 46 has been passed over, the opening 34 of a respective working chamber 24 passes over the reversing surface 78. Consequently, the hydrostatic working chamber 24 is fluidically separated from the high-pressure chamber 40. Up to the dead point of the reversing surface 78, which is diametrically opposite the dead point of the reversing surface 76, there is a further introduction of the working piston 22 and therefore a reduction in the volume of the hydrostatic working chamber 24.

As already described, connecting the high-pressure-guiding working chamber 24 directly to the low-pressure chamber 42 during further rotation has proved problematic. As depicted above, there would be an abrupt decrease in the pressure of the pressurizing medium in the hydrostatic working chamber 24 into the low-pressure chamber 42 and therefore high flow speeds. In traditional piston engines, this affects the induction performance in the working cycle until cavitation occurs due to high flow speeds and low pressure. Pressurizing medium channels formed by the reset grooves 72 and 74 have a bearing on these problems.

According to FIG. 2, two through-bores with a small diameter are arranged radially offset to one another in the region of each of the reversing surfaces 76, 78. According to FIGS. 2 and 3, a radially outwardly arranged through-recess 80 of the reversing surface 78 is in pressurizing medium connection with an end portion of the reset groove 72 and a radially inwardly arranged through-recess 82 of the reversing surface 78 is in pressurizing medium connection with an end portion of the reset groove 74. A first pressurizing medium channel is formed by the through-recess 80 and the reset groove 72, and also the control plate 38 covering said reset groove, and a second pressurizing medium channel is formed by the through-recess 82, the reset groove 74 and the control plate 38 covering it.

Returning to the description of the cycle of the hydrostatic working chamber 24 and its opening 34, when passing over the reversing surface 78 the aforementioned opening initially comes into pressurizing medium connection with the two through-recesses 80, 82 before it brings the working chamber 24 into pressurizing medium connection with the low-pressure kidney 44. In this way, the so-called "resetting" of the high pressure prevailing in the hydrostatic working chamber 24 is possible via the pressurizing medium channels 80, 72 and 82, 74 (as already mentioned, created by covering by the control plate 38). The decrease in pressure of the pressurizing medium from the hydrostatic working chamber 24 does not therefore take place in the low-pressure kidney 44, but in a controlled manner via the reset grooves 72, 74 in the housing interior 58.

Figure 4:
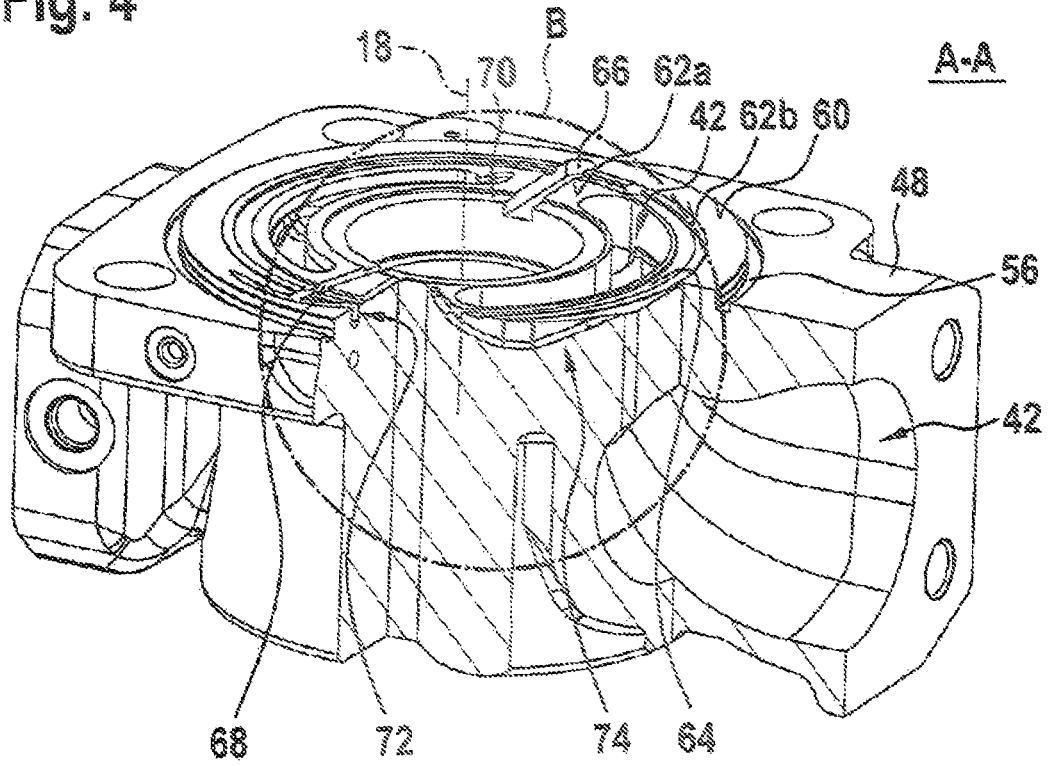
FIG. 4 shows the connection plate according to the preceding figures as a perspective, partially sectional representation
Figure 5:
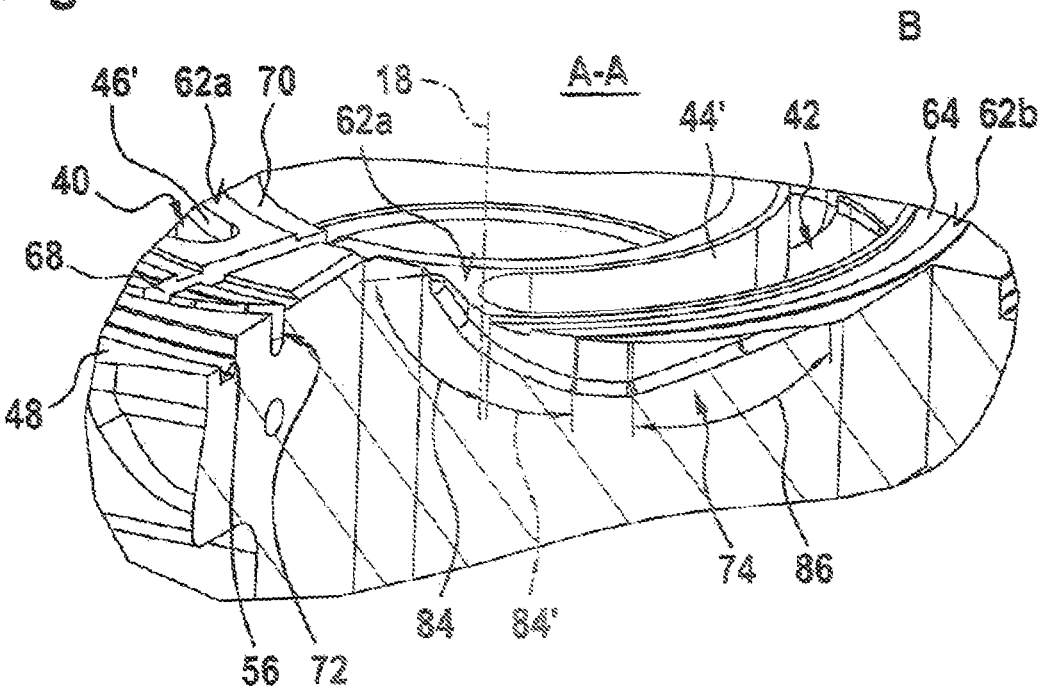
FIG. 5 shows a detail depiction of the partial section according to FIG. 4.

According to FIGS. 4 and 5, the reset grooves 72 and 74 have cross-sectional profiles which result in cavitation being sharply reduced or even prevented in the grooves 72, 74 and therefore on the connection plate 6. The reset groove 74 which is shown in detail in its cross-sectional development in FIG. 5 has a first portion 84 that extends from the inner bearing surface 62*a* to a radial inner wall of the ring groove 64. In this first portion 84, the flow cross section of the pressurizing medium channel formed by the reset groove 74 and the control plate 38 covering it increases constantly. In this way, the flow speed in the pressurizing medium channel is slowed down constantly, in other words not erratically, so that no flow separation and also no cavitation can take place. In this way, the reset groove 74 is better protected from erosion and damage. The same observations apply to the reset groove 72 and the pressurizing medium channel formed by the covering control plate 38. Furthermore, the reset groove 74 has a second portion 86 which extends radially outside the outer bearing surface 62*b* and which is not covered by the control plate 38 according to FIG. 2. In the second portion 86, the flow cross section of the reset groove 74 diminishes again constantly, as a result of which the flow from the reset groove 74 is directed with a directional component parallel to the rotational axis 18 in the housing interior 58. Tests have shown that this deflection further lowers the tendency towards cavitation, in particular at the end of the groove, which can be explained where appropriate by greater dynamic pressures. On observing FIGS. 2 to 5, it becomes evident that the reset groove 74 runs substantially in the rotational direction (in an anticlockwise direction according to FIG. 2) and the reset groove 72 runs substantially against the rotational direction. Here too, tests have shown that both the existence of two pressurizing medium channels or reset grooves and the orientation of the second reset groove against the rotational direction have a positive effect on cavitation insulation. Even if it is not shown, the reset groove 72 has a similar cross-sectional profile with a first portion and second portion like the reset groove 74, so that no further explanations are needed in this respect.

The dimensions of the first portion 84 according to FIG. 5 fit the definition that the first portion not only has an increasing, but a constantly increasing, flow cross section. The first portion 84 therefore ends when it reaches the ring groove 64 which (strictly speaking) represents a sharp cross-sectional jump. With a less rigorous observation and excluding the ring groove 64 from the dimensions of the flow cross section of the pressurizing medium channel, there results an extension of the first portion 84 of the bearing surface 62*a* according to the reference number 84'.

According to FIG. 2, two other through-bores 88, 90 are formed in the control plate 38 opposite the through-bores 80, 82. According to FIG. 3, they both correspond to a reversing notch 92 leading from the high-pressure kidney 46' on an end portion side. In the cycle, the hydrostatic working chamber 24 which is filled with low-pressure pressurizing medium by this point initially comes into throttled pressurizing medium connection with the high-pressure kidney 46' and therefore the high-pressure chamber 40 via the reversing notch 92 and the through-bores 88, 90, before the respective opening 34 passes over the first through-bore 46. In this way, cavitation is prevented or sharply reduced in the region of the opening 34 of the hydrostatic working chambers 24.

A hydrostatic piston engine with hydrostatic working chambers is disclosed, the openings of which come into alternating pressurizing medium connection with outlets in a high-pressure chamber and a low-pressure chamber of the piston engine and a reverse surface arranged therebetween, wherein at least one pressurizing medium channel is provided which, on the one hand, opens out in the reversing surface and, on the other, into a pressurizing medium trough in the piston engine, wherein a flow cross section increases at least along a first portion of the pressurizing medium channel to the pressurizing medium trough.

LIST OF REFERENCE NUMBERS

1 hydrostatic axial piston engine
2 housing
4 housing part
6 connection plate
8 drive shaft
9 drive shaft stub
10, 12 rolling bearing
14 base
16 cylinder drum
18 rotational axis
20 cylinder bore
22 working piston
24 hydrostatic working chamber
26 piston head
28 sliding shoe
30 swash plate
32 pivoting cradle
34 opening
36 face side
38 control plate
40 high-pressure chamber
41 high-pressure outlet
42 low-pressure chamber

43 low-pressure outlet
44 low-pressure kidney
46 high-pressure through-bore
48 sealing surface
50 annular face side
54 through-bore
56 sealing groove
58 housing interior
60 low-pressure area
62, 62*a*, 62*b* bearing surface
64 ring groove
66, 68 radial groove
70 low-pressure surface
72, 74 reset groove
76, 78 reversing surface
80, 82 through-bore
84, 84' first portion
86 second portion
88, 90 through-bore
92 reversing notch

What is claimed is:

1. A hydrostatic piston engine, comprising:

a housing;

a high-pressure chamber operably connected to the housing;

a low pressure chamber operably connected to the housing;

a cylinder drum mounted rotatably within the housing and defining a plurality of cylinder bores, each cylinder bore receiving a corresponding working piston of a plurality of working pistons in a longitudinally displaceable manner;

a control plate supported by the housing and defining at least one low-pressure opening, at least one high-pressure opening, and a reversing surface, wherein each cylinder bore and each corresponding working piston defines a corresponding hydrostatic working chamber of a plurality of hydrostatic working chambers, wherein each hydrostatic working chamber has a corresponding opening of a plurality of openings on an outer surface of the cylinder drum, wherein when the cylinder drum rotates in a rotational direction, each corresponding opening is fluidly coupled to (i) the high-pressure chamber through the at least one high-pressure opening, (ii) the low-pressure chamber through the at least one low-pressure opening, or (iii) the reversing surface which is located between the at least one high-pressure opening and the at least one low pressure opening in the rotational direction, wherein at least one pressurizing medium comprises at least one opening in and extending from the reversing surface to a pressurizing medium trough, wherein the at least one pressurizing medium channel has a first portion along which a flow cross section increases in a flow direction from the reversing surface towards the pressurizing medium trough, wherein the reversing surface completely defines a periphery of the least one opening, and wherein the at least one pressurizing medium channel extends completely through the control plate in an axial direction perpendicular to the rotational direction.

2. The piston engine according to claim 1, wherein the at least one pressurizing medium channel has a second portion spaced apart from the control plate and arranged downstream of the first portion in the flow direction.

3. The piston engine according to claim 2, wherein the second portion opens out into the pressurizing medium trough.

4. The piston engine according to claim 2, wherein the control plate is detachable from the housing.

5. The piston engine according to claim 1, wherein a flow cross section of at least the first portion increases in one of (i) a continuous manner, and (ii) a stepless manner.

6. The piston engine according to claim 1, wherein an inner curved surface of the second portion of the at least one pressurizing medium channel has at least one of (i) a smooth configuration, and (ii) a stepless configuration, at least in the flow direction.

7. The piston engine according to claim 1, wherein an inner curved surface of the second portion of the at least one pressurizing medium channel has at least one of (i) a tangentially constant configuration, and (ii) a curvature-constant configuration at least in the flow direction.

8. The piston engine according to claim 1, wherein the at least one pressurizing medium channel extends radially outwards from the at least one opening in the reversing surface.

9. The piston engine according to claim 1, wherein the at least one pressurizing medium channel includes a first pressurizing medium channel extending from a first opening of the at least one opening in the reversing surface, and a second pressurizing medium channel extending from a second opening of the at least one opening in the reversing surface.

10. The piston engine according to claim 9, wherein:

the first pressurizing medium channel extends from the first opening of the at least one opening in the rotational direction; and the second pressurizing medium channel extends from the second opening of the at least one opening against the rotational direction.

11. The piston engine according to claim 9, wherein the first and the second pressurizing medium channels open out in the reversing surface at least one of (i) radially offset, and (ii) offset in the rotational direction.

12. The piston engine according to claim 1, wherein the first portion of the at least one pressurizing medium channel is spaced apart from the at least one low-pressure opening and the at least one high-pressure opening.

13. A hydrostatic piston engine, comprising:

a high-pressure chamber;

a low pressure chamber; and a housing with a rotatably mounted cylinder drum, the cylinder drum defining a plurality of cylinder bores, each cylinder bore of the plurality of cylinder bores receiving a corresponding working piston of a plurality of working pistons in a longitudinally displaceable manner, via which a hydrostatic working chamber is delimited by the cylinder bore;

wherein each hydrostatic working chamber has an opening on an outer surface of the cylinder drum by which passes, when the cylinder drum rotates, outlets of the high-pressure chamber and of the low-pressure chamber and a reversing surface arranged between the two outlets in the rotational direction, wherein at least one pressurizing medium channel opens out in the reversing surface and into a pressurizing medium trough, wherein the at least one pressurizing medium channel has a first portion along which a flow cross section increases towards the pressurizing medium trough, wherein the reversing surface and the outlets of the at least one pressurizing medium channel, of the high-pressure chamber and of the low-pressure chamber are configured on a control plate that is detachable from a housing portion with which the outer surface is in abutment, wherein the at least one pressurizing medium channel is defined, at least partially, by a groove formed on the housing portion, and wherein the control plate is configured to cover the groove, at least partially.

14. The piston engine according to claim 13, wherein:

the at least one pressurizing medium channel has a second portion arranged downstream of the first portion, and a base of the groove drops off along the first portion and rises along the second portion relative to a bearing surface of the housing portion.

15. The piston engine according to claim 14, wherein the first portion one of (i) extends starting from the bearing surface, and (ii) extends spaced apart from the bearing surface.

16. The piston engine according to claim 13, wherein:

the at least one pressurizing medium channel has a second portion arranged downstream of the first portion, and the second portion is only formed by the groove.

* * * * *